US008141648B2

(12) United States Patent
Darnell et al.

(10) Patent No.: US 8,141,648 B2
(45) Date of Patent: Mar. 27, 2012

(54) MULTIPLE-POSITIONING MECHANICAL SHIFTING SYSTEM AND METHOD

(75) Inventors: William John Darnell, Houston, TX (US); Charles David Wintill, Houston, TX (US); Rodney Wayne Long, Cypress, TX (US); Todd Ulrich Chretien, Lafayette, LA (US)

(73) Assignee: Petroquip Energy Services, LP, Houston, TX (US)

( * ) Notice: Subject to any disclaimer, the term of this patent is extended or adjusted under 35 U.S.C. 154(b) by 262 days.

(21) Appl. No.: 12/437,805

(22) Filed: May 8, 2009

(65) Prior Publication Data

US 2010/0282475 A1 Nov. 11, 2010

(51) Int. Cl.
*E21B 34/14* (2006.01)
*E21B 43/12* (2006.01)

(52) U.S. Cl. ..... 166/386; 166/332.4; 166/334.4; 166/373

(58) Field of Classification Search ..... 166/373, 166/386, 332.4, 334.4
See application file for complete search history.

(56) References Cited

U.S. PATENT DOCUMENTS

| | | | | |
|---|---|---|---|---|
| 3,051,243 | A * | 8/1962 | Grimmer et al. | 166/332.7 |
| 3,166,128 | A * | 1/1965 | Myers | 166/214 |
| 4,436,152 | A | 3/1984 | Fisher, Jr. et al. | |
| 4,896,721 | A | 1/1990 | Welch | |
| 5,305,833 | A | 4/1994 | Collins | |
| 5,549,161 | A | 8/1996 | Gomez et al. | |
| 5,641,023 | A | 6/1997 | Ross et al. | |
| 5,678,633 | A | 10/1997 | Constantine, Jr. | |
| 6,189,619 | B1 | 2/2001 | Wyatt et al. | |
| 6,631,768 | B2 | 10/2003 | Patel et al. | |
| 6,722,439 | B2 | 4/2004 | Garay et al. | |

* cited by examiner

*Primary Examiner* — Giovanna Wright
(74) *Attorney, Agent, or Firm* — Jones Walker

(57) ABSTRACT

A multiple-positioning mechanical shifting system including for used in hydrocarbon wells. The system includes a shifting tool capable of selectively positioning a mechanical sliding sleeve valve in multiple operational positions that varying the flow rate and/or volume of tubing string fluid flowing to the well annulus. The system also includes a multiple position mechanical choke valve. A method of operating the mechanical choke valve using the shifting tool is described.

25 Claims, 6 Drawing Sheets

MULTIPLE-POSITIONING MECHANICAL SHIFTING SYSTEM AND METHOD

FIELD OF THE INVENTION

The present invention relates to a multiple-positioning mechanical shifting system and method for use in hydrocarbon wells and more particularly to a shifting tool for manipulation of a mechanical sliding sleeve valve capable of multiple operational positions.

BACKGROUND OF THE INVENTION

Sliding sleeve valves have been used in tubing string for oil and gas wells to control fluid flow between the tubing string and the well annulus during circulation or production. The valves contain an inner sliding sleeve having a port that can be shifted to an opened position in alignment with a port in the outer valve body to permit fluid to flow from the tubing string to the well annulus. Shifting the sliding sleeve to a closed position blocks the port in the valve body to prevent the fluid from flowing into the well annulus. Mechanical sliding sleeve valves are manipulated by shifting tools customarily deployed on wireline or slickline. Shifting tools move the sliding sleeve to either the fully shifted up or fully shifted down position. Accordingly, sliding sleeve valves customarily have only two positions opened or closed.

Sliding sleeve valves have been developed that have a third position known as the equalizing position. The equalizing position is located intermediate of the opened and closed positions. In these valves, a smaller diameter equalizing port is provided in the inner sliding sleeve. The equalizing port serves to balance the tubing pressure and the annulus pressure before fully opening the valve in order to reduce the likelihood of a pressure surge as the valve is fully opened. The process of equalizing the pressures is carried out by shifting the sliding sleeve to a position where the equalizing port in the sliding sleeve is in fluid communication with the port of the valve body. Shifting tools have been produced to manipulate such sliding sleeve valves. U.S. Pat. No. 5,305,833, which is incorporated herein by reference, describes a shifting tool capable of positioning a sliding sleeve valve in a fully closed position, equalizing position, and fully opened position.

Multi-positioned sliding sleeve valves have also been developed. U.S. Pat. No. 6,722,439, which is incorporated herein by reference, describes a downhole choke valve in the form of a hydraulically controlled sliding sleeve valve operable in a plurality of positions including fully opened, fully closed and intermediate positions.

Despite the development of shifting tools that can position a sliding sleeve valve in three distinct positions, fully closed, equalizing, and fully opened, the need still exists for a shifting tool that can position a mechanical sliding sleeve valve in multiple positions and which can be used in conjunction with a multiple position mechanical choke valve.

SUMMARY OF THE INVENTION

It is an object of the present invention to provide mechanical shifting system that functions as a multiple position mechanical choke valve.

It is a further object of the present invention to provide a shifting tool for use with a multiple position mechanical sliding sleeve valve.

It is a further object of the present invention to provide a multiple position mechanical choke valve.

These objects and other objects and advantages of the present invention are achieved by a novel multiple-position shifting system which includes a shifting tool for use with a mechanical sliding sleeve valve deployed in a tubing string of a hydrocarbon well. The sliding sleeve valve may include an internal sliding sleeve and an outer valve body. The shifting tool may include a top sub. A shifting tool key may be positioned on the top sub. The shifting tool key may be radially expandable to engage the internal sliding sleeve to enable shifting of the internal sliding sleeve relative to the outer valve body by displacement of the shifting tool within the sliding sleeve valve during valve shifting operations. The shifting tool key may also be radially retractable to disengage from the internal sliding sleeve to enable release of the sliding sleeve valve from the shifting tool during valve release operations. The shifting tool may also include a bottom sub.

The shifting tool may include a reciprocating assembly interconnecting the top sub and the bottom sub. The reciprocating assembly may include an inner mandrel and an outer housing disposed about the inner mandrel. The outer housing may have a biasing means to reciprocate the outer housing in a first direction during the valve shifting operations. The outer housing may also have an actuating means to cause reciprocation of the outer housing in a second direction during said valve release operations. The actuating means may operatively cooperate with the shifting tool key during valve release operations to disengage the shifting tool key from the internal sliding sleeve to place the internal sliding sleeve at a spatial position relative to said valve body. The spatial position may be selected from a plurality of possible spatial positions.

The shifting tool key may be retained on the top sub by a pair of retainers detachably affixed to the top sub. The top sub and the bottom sub may each be threadedly connected to the inner mandrel of the reciprocating assembly. The outer housing of the reciprocating assembly may be moveably connected to the inner mandrel of the reciprocating assembly.

The shifting tool key may have an outer profile that includes an engagement shoulder. The engagement shoulder may cooperate with a mating shoulder on the internal sliding sleeve. The cooperation between the engagement shoulder and the mating shoulder may enable the engagement of the shifting tool key with the internal sliding sleeve during valve shifting operations.

The outer profile of the shifting tool key may also include a releasing shoulder. The releasing shoulder may be actuated to radially retract the shifting tool key to disengage the engagement shoulder from the mating shoulder during valve release operations. The releasing shoulder may be actuated by reciprocation of the outer housing in the second direction.

The shifting tool key may also include biasing means. The biasing means may cause the radial expansion of the shifting tool key. The shifting tool key may have a recess. The recess may house or contain the biasing means. The biasing means may be a spring.

The reciprocating assembly may likewise include a recess. The recess may house or contain the biasing means of the reciprocating assembly. The biasing means may be a spring.

The sliding sleeve valve may contain an end sub. When the actuating means on the outer housing of the reciprocating assembly engages the end sub (during valve release operations), the outer housing is reciprocated in the second direction to disengage the shifting tool key from the internal sliding sleeve. Reciprocation in the second direction occurs by compression of the biasing means housed in the reciprocating assembly.

The actuating means may be any device that is capable of engaging or cooperating against the end sub to move or reciprocate the outer housing in the second direction. For example, the actuating means may be one or more collets.

The feature of the present invention wherein the internal sliding sleeve may be released at multiple positions relative to the outer valve body may be achieved based on a specified distance or length between the releasing shoulder of the shifting tool key and the actuating means on the outer housing of the reciprocating assembly. Such distance or length may be determinative of the spatial positioning of the internal sliding sleeve relative to the outer valve body. Accordingly, the shifting tool of the present invention may include a means to adjust the distance or length between the releasing shoulder and the actuating means to achieve multiple positioning of the internal sliding sleeve.

In one embodiment of the present invention, the mechanical sliding sleeve valve is a mechanical choke valve in which the internal sliding sleeve includes a plurality of a series of ports capable of providing fluid communication of the tubing string fluid there-through. Each of the plurality of the series of ports may provide a different flow rate and/or volume of the tubing string fluid flowing there-through. The spatial position selected for the internal sliding sleeve as described above may comprise one of the plurality of the series of ports, which are aligned with one or more ports in the outer valve body.

In another embodiment of the present invention, a shifting tool is provided for use with a mechanical sliding sleeve valve deployed in a tubing string of a hydrocarbon well. The mechanical sliding sleeve valve may include an internal sliding sleeve, an outer valve body, and an end sub. The shifting tool may include a top sub. The shifting tool may also include a shifting tool key positioned on the top sub. The shifting tool key may include an outer profile having an engagement shoulder and a release shoulder. The shifting tool key may also include a biasing means to radially expand the shifting tool key for engagement of the engagement shoulder with a mating shoulder of the internal sliding sleeve to enable shifting of the internal sliding sleeve relative to the outer valve body by displacement of the shifting tool within the sliding sleeve valve during valve shifting operations. The bias means also permit the radial retraction of the shifting tool key to disengage the engagement shoulder from the mating shoulder to enable release of the sliding sleeve valve from the shifting tool during valve release operations.

The shifting tool may also have a bottom sub. A reciprocating assembly may interconnect the top and bottom subs. The reciprocating assembly may include an inner mandrel and an outer housing disposed about the inner mandrel. The outer housing may have an upper end and a lower end. The outer housing may also have a biasing means to reciprocate the outer housing in a first direction during the valve shifting operations. The outer housing may include an actuating means to cause reciprocation of the outer housing in a second direction during the valve release operations by compressing the biasing means of the reciprocating assembly when the actuating means engages the end sub. The actuating means may operatively cooperate with the shifting tool key during valve release operations to cause the upper end of the outer housing to collapse the release shoulder to disengage the engagement shoulder from the mating shoulder and thereby place the internal sliding sleeve at a spatial position relative to said valve body. The spatial position may be selected from three or more possible spatial positions based on a pre-selected distance between the actuating means and the release shoulder. In this embodiment, the actuating means may be one or more collets.

The shifting tool may be deployed on wireline and preferably slickline. However, the shifting tool could also be deployed on coiled tubing or pipe string.

The present invention also is directed to a novel method of operating a mechanical sliding sleeve valve having an internal sliding sleeve, an outer valve body and an end sub for selective placement of the internal sliding sleeve at a spatial position relative to the valve body. The spatial position may be selected from any number of possible spatial positions or a plurality of possible spatial positions.

The method includes providing a shifting tool as set forth and described above. The method also includes pre-selecting the distance between the actuating means on the outer housing of the reciprocating assembly and the release shoulder on the shifting tool key. The shifting tool is deployed down a tubing string. The tubing string may include or contain the mechanical sliding sleeve valve. The method includes the step of causing the engagement shoulder on the shifting tool key to engage the mating shoulder on the internal sliding sleeve to operatively connect the shifting tool and the internal sliding sleeve. The method involves shifting the internal sliding sleeve relative to the valve body by displacing the shifting tool within the mechanical sliding sleeve valve. The outer housing is reciprocated in the second direction by causing the actuating means to engage the end sub so as to affect compression of the biasing means in the reciprocating assembly. The method includes the step of causing the upper end of the outer housing to collapse the release shoulder to disengage the engagement shoulder from the mating shoulder thereby releasing the internal sliding sleeve from the shifting tool at a selected spatial position relative to the valve body. The spatial position where the internal sliding sleeve is released may be pre-determined by selecting a specified distance between the actuating means and the release shoulder. The selected spatial position of the internal sliding sleeve achieved may be a fully closed position, a plurality of intermediate positions, an equalizing position, or a fully opened position.

The step of pre-selecting the distance between the actuating means and the release shoulder may be undertaken by: (i) adjusting the length of the outer housing where the actuating means is at a fixed position on the outer housing; (ii) adjusting the position of the actuating means on the outer housing where the actuating means is detachably fixed to the outer housing; or (iii) affixing a selected outer housing having a specified length and a fixed actuating means thereon (the selected outer housing may be chosen from among a plurality of outer housings each having a different length and a fixed actuating means thereon).

The shifting tool of the present invention may be used with a mechanical choke valve deployed in a tubing string of a hydrocarbon well. The mechanical choke valve may include an internal sliding sleeve. The internal sliding sleeve may have a mating shoulder for operable engagement with the shifting tool as described above. The internal sliding sleeve may have a plurality of a series of ports capable of providing fluid communication of a tubing string fluid there-through. Each of the plurality of series of ports may provide a different flow rate and/or volume of the tubing string fluid flowing there-through. The mechanical choke valve may also include an outer valve body disposed about the internal sliding sleeve. The outer valve body may have one or more ports capable of providing fluid communication of the tubing string fluid there-through. Preferably, each of the plurality of series of ports in the internal sliding sleeve may be capable of being selectively aligned with one or more ports of the outer valve body to provide fluid communication of the tubing string fluid to the well annulus by displacement of the shifting tool as described hereinabove.

Each embodiment of the shifting tool described above may be used in connection with the operation of the mechanical choke valve.

The mechanical choke valve of the present invention may also include an outer valve body that has one or more detent grooves. The internal sliding sleeve may be provided with one or more locking collets. The locking collect may be snapped into positioned within a corresponding detent groove to lock the internal sliding sleeve in place when the internal sliding sleeve is released from the shifting tool. The locking of the collect with the detent grooves helps prevent any unintentional shifting of the internal sliding sleeve due to fluid pressures in the tubing string.

In an embodiment of the mechanical choke valve, the plurality of series of ports of the internal sliding sleeve include: (1) a first series of ports that when aligned with one or more ports of the outer valve body place the mechanical choke valve in a fully opened position; (2) a second series of ports that when aligned with one or more ports of the outer valve body place the mechanical choke valve in a first intermediate position; (3) a third series of ports that when aligned with one or more ports of the outer valve body place the mechanical choke valve in a second intermediate position.

DETAILED DESCRIPTION OF THE PREFERRED EMBODIMENTS

Figure 1A:
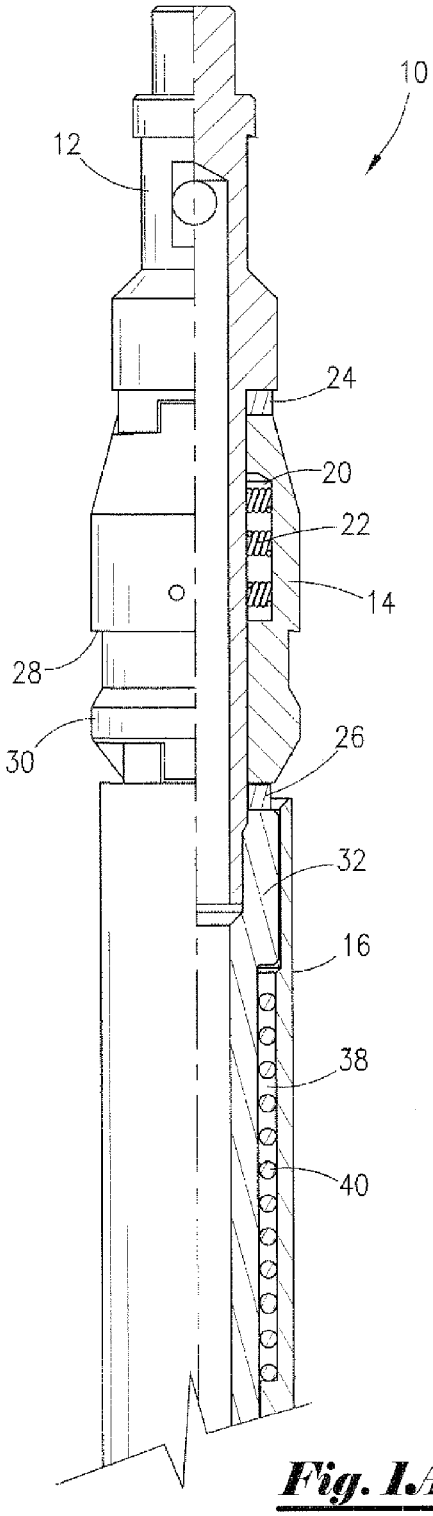
FIGS. 1A and 1B are a sequential partial, cross-sectional side view of an embodiment of the shifting tool of the mechanical shifting system of the present invention.
Figure 1B:
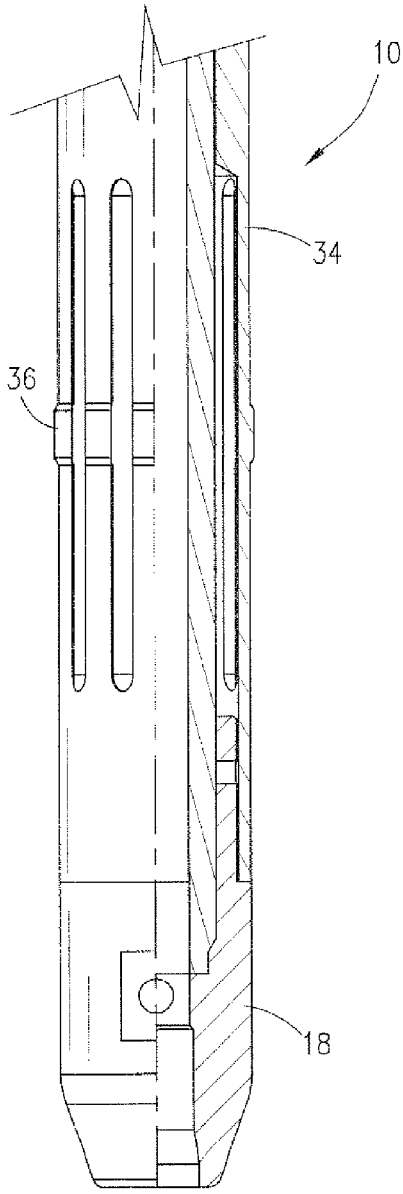

With reference to the figures where like elements have been given like numerical designation to facilitate an understanding of the present invention, and in particular with reference to the embodiment of the present invention illustrated in FIG. 1, shifting tool 10 may include top sub 12, shifting tool key 14, reciprocating assembly 16 and bottom sub 18. Top sub 12 and bottom sub 18 are positioned in spaced apart relation and interconnected by reciprocating assembly 16. Shifting tool key 14 is positioned on the outer surface of top sub 12 between upper key retainer 24 and lower key retainer 26. Upper and lower key retainers 24, 26 maintain shifting key 14 in position relative to top sub 12. Upper and lower key retainers 24, 26 are preferably slidably positioned on top sub 12 and held in place by mandrel 32.

Shifting tool key 14 may include recess 20 that accommodates biasing means 22. Biasing means 22 are capable of causing the radial, outward expansion of shifting key 14. Biasing means 22 may be a spring such as a grasshopper spring or butterfly spring. Shifting tool key 14 may include an outer profile containing engagement shoulder 28 and releasing shoulder 30. When radially expanded, the outer profile of shifting tool key 14 cooperates with a mating profile on the inner surface of internal sliding sleeve 44 of mechanical sliding sleeve valve 42. For example, engagement shoulder 28 may cooperate with mating shoulder 52 of internal sliding sleeve 44 as shown in FIG. 2.

Again with reference to FIG. 1, reciprocating assembly 16 includes mandrel 32 and outer housing 34. The upper end of mandrel 32 is detachably connected to the lower end of top sub 12 preferably by threaded connection. The lower end of mandrel 32 is detachably connected to the upper end of bottom sub 18 preferably by threaded connection. Outer housing 16 is positioned external to and around mandrel 32. The outer surface of outer housing 16 contains one or more collets 36. Reciprocating assembly 16 also includes recess 38 that accommodates biasing means 40. Biasing means 40 bias or expand outer housing 16 downwardly when shifting tool 10 is prepared to conduct or is conducting valve shifting operations. Biasing means 40 may be a spring such as a compression spring.

Figure 2A:
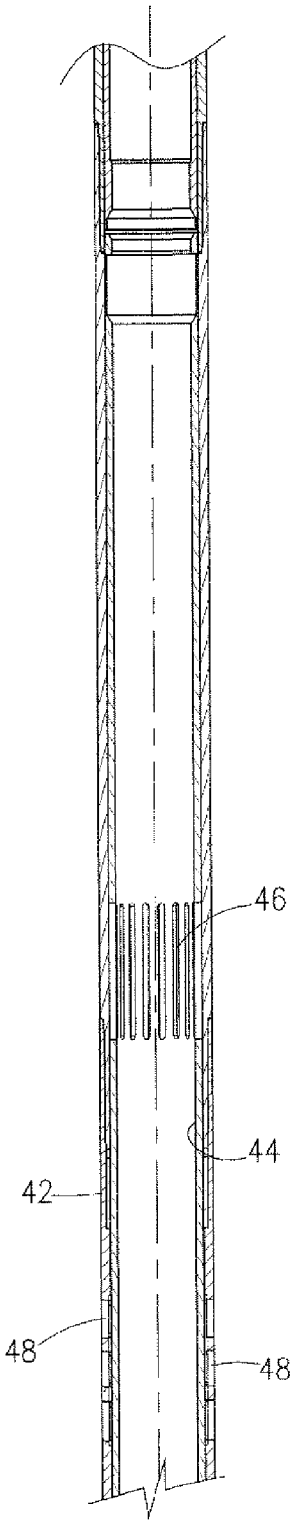
FIGS. 2A and 2B are a sequential cross-sectional side view of the mechanical shifting system of the present invention with the shifting tool situated within the sliding sleeve valve in a closed position.
Figure 2B:
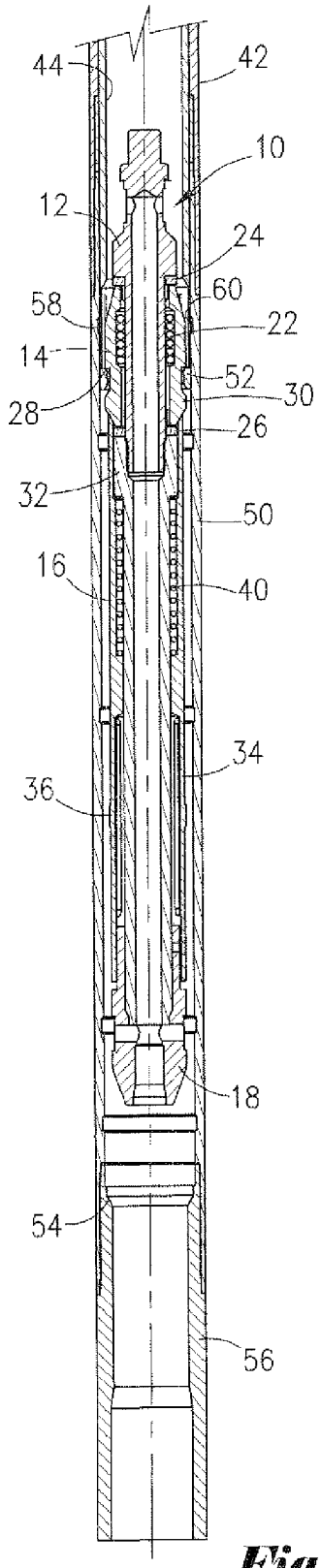

In FIG. 2, shifting tool 10 has been run down hole by conventional means such as wireline or slickline. It is to be understood that shifting tool 10 could also be operated on coiled tubing or pipe. Shifting tool 10 is situated within mechanical sliding sleeve valve 42. Sliding sleeve valve 42 may be connected to a work string such as production tubing. Shifting tool 10 is operationally engaged with sliding sleeve valve 42 and in particular with sliding sleeve 44 by conventional procedures well known to those skilled in the art.

Figure 3A:
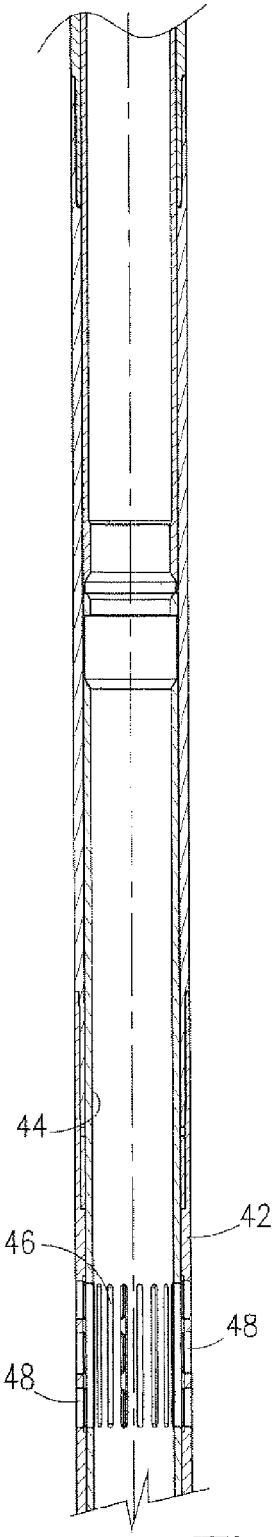
FIGS. 3A and 3B are a sequential cross-sectional side view of the mechanical shifting system of the present invention with the shifting tool situated within the sliding sleeve valve in an opened position.
Figure 3B:
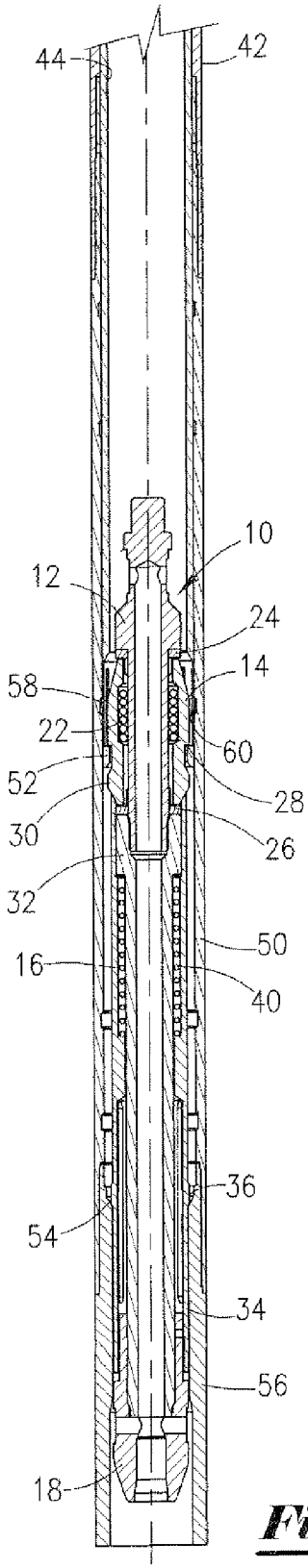

With reference to FIG. 3, shifting tool 10 has been lowered within sliding sleeve valve 42 such that sliding sleeve 44 as been repositioned so that ports 46 on sliding sleeve 44 are aligned with ports 48 on outer valve body 50 to permit the flow of fluid between the tubing string and the well annulus. Repositioning of sliding sleeve 44 is accomplished by physical force, namely causing shifting tool 10 to push internal sliding sleeve 44 downward within outer valve body 50. It is to be understood that reposition of internal sliding sleeve 44 may also be accomplished by causing shifting tool 10 to pull internal sliding sleeve 44 upward within outer valve body 50. The force of shifting tool 10 is transferred to internal sliding sleeve 44 by engagement of engaging shoulder 28 of shifting tool key 14 with mating shoulder 52 of internal sliding sleeve 44.

Again with reference to FIG. 3, as shifting tool 10 travels downward through sliding sleeve valve 42, collet 36 on outer housing 34 encounters and engages shoulder 54 on end sub 56, which is connected to and a part of sliding sleeve valve 42. The engagement of collect 36 with shoulder 54 causes compression of biasing means 40 and the upward movement, relative to shifting tool 10, of outer housing 34. The upper end of outer housing 34 contacts or engages releasing shoulder 30 of shifting tool key 14. The engagement of outer housing 34 with releasing shoulder 30 causes compression of biasing means 22 and the radial inward retraction of shifting tool key 14. The radial inward retraction of shifting tool key 14 releases sliding sleeve 44 from connection with shifting tool 10. Shifting tool 10 may then be relocated without interfering with or causing sliding sleeve 44 to be repositioned.

Figure 4:
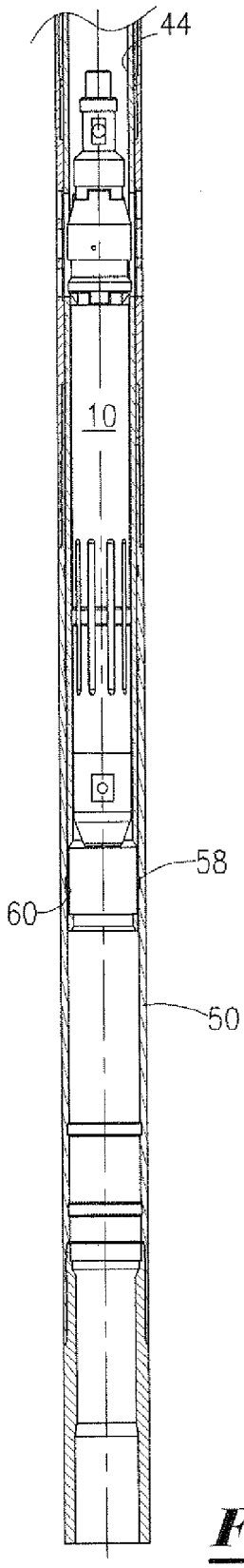
FIG. 4 is a cross-sectional side view of the mechanical shifting system of the present invention with the shifting tool situated within the sliding sleeve valve after release of the sliding sleeve.

As seen in FIGS. 2-4, the outer surface of internal sliding sleeve 44 may have one or more locking collets 58 which cooperate with one or more detent grooves 60 in the inner surface of valve body 50 to lock sliding sleeve 44 in position on valve body 50 and keep it from being unintentionally shifted. Locking collets 58 may be positioned at varying locations on the outer surface of internal sliding sleeve 44. For example, locking collets 58 may be positioned at locations on the outer surface of internal sliding sleeve 44 that correspond to the closed position, fully opened position, equalizing position, or any intermediate position of sliding sleeve valve 42.

The releasing mechanism of shifting tool 10 may be employed to selectively place sliding sleeve 44 at a spatial position relative to outer valve body 50. Such selective placement of sliding sleeve 44 is accomplished by varying the distance or length between collet 36 of outer housing 34 and releasing shoulder 30 of shifting tool key 14. For example, a greater distance between collet 36 and releasing shoulder 30 would mean that sliding sleeve 44 will be released, and therefore placed, at a higher location within sliding sleeve valve 42. A lesser distance between collet 36 and releasing shoulder 30 would mean that sliding sleeve 44 will be released, and therefore placed, at a lower location within sliding sleeve valve 42. Any number of placement positions is achievable with shifting tool 10 such as fully opened, fully closed, or one or more intermediate positions between fully opened and fully closed.

Varying the distance between collet 36 on outer housing 34 and releasing shoulder 30 of shifting tool key 14 may be accomplished in a number of ways. For instance, outer housing 34 could be made so that its length could be adjusted to account for variable distances between collet 36 and releasing shoulder 30. One or more segments of outer housing 34 could be added to increase the overall length of outer housing 34 or removed to decrease the overall length of outer housing 34. Alternatively, outer housing could be made so that the positioning of collet 36 on outer housing 34 could be adjusted to account for variable distances between collet 36 and releasing shoulder 30. Collet 36 could be detachably connected to outer housing 34 and movable in a downward direction on outer housing 34 to increase the distance between collet 36 and releasing shoulder 30 or moveable in an upward direction on outer housing 34 to decrease the distance between collet 36 and releasable shoulder 30. As another alternative, outer housing 34 could be made in multiple lengths. If an operator desired to increase the distance between collet 36 and releasable shoulder 30, the operator could configure shifting tool 10 with one of the outer housings 34 having a greater length. Conversely, if an operator desired to decrease the distance between collet 36 and releasable shoulder 30, the operator could configure shifting tool 10 with one of the outer housings 34 having a shorter length.

As shown in FIG. 4, sliding sleeve valve 44 has been released from shifting tool 10. Shifting tool 10 is free to move upward or downward within sliding sleeve valve 42 without causing the movement of internal sliding sleeve 44. As described earlier herein, after release, sliding sleeve 44 may be locked into position on outer valve body 50 by engagement of locking collet 58 in detent groove 60.

Figure 5:
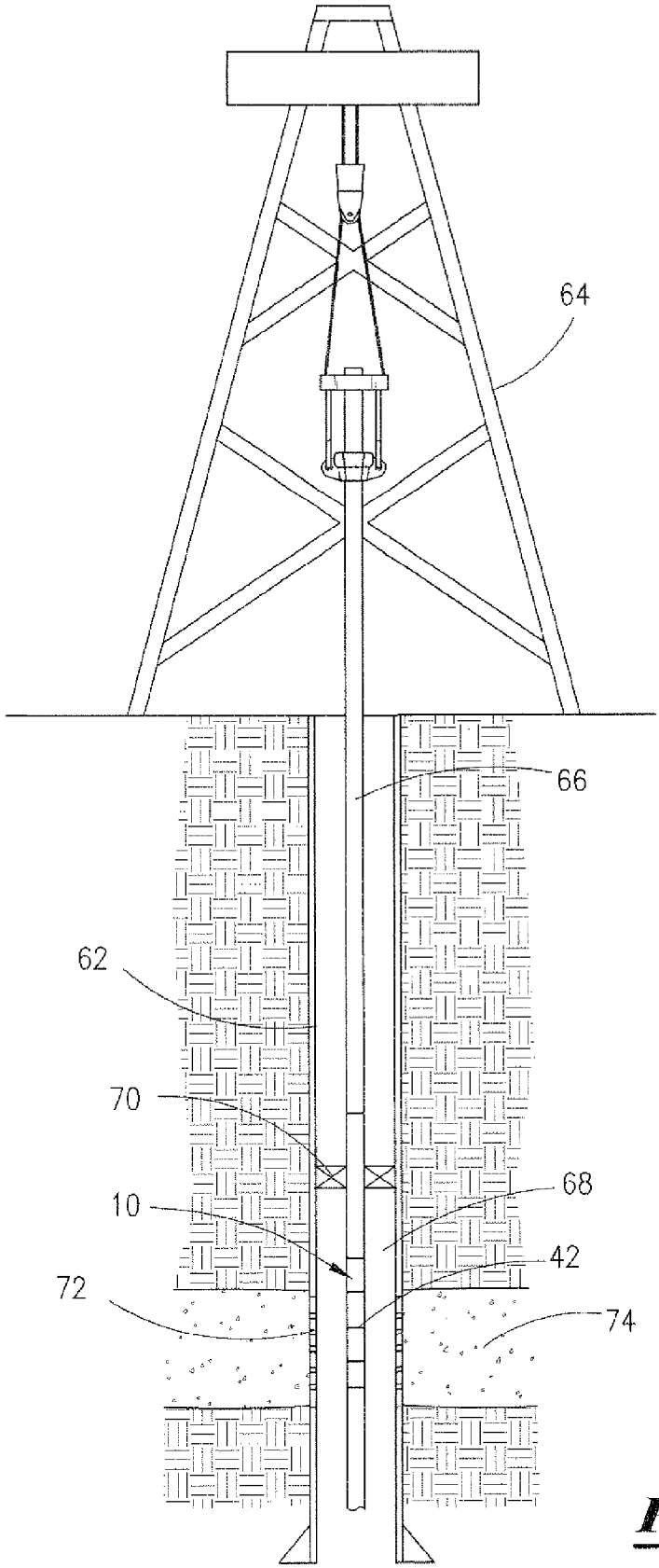
FIG. 5 is a schematic illustration of the mechanical shifting system of the present invention suspended within a well from a platform.

FIG. 5 is a schematic illustration of shifting tool 10 suspended within well 62 from drilling rig 64. Shifting tool 10 is operatively positioned within sliding sleeve valve 42 which is connected to work string 66. Shifting tool 10 is preferably deployed in work string 66 on wireline or slickline (not shown). The outer surface of work string 66 and well 62 form well annulus 68. Packer means 70 is set in well 62. Packer mean 70 is operatively attached to work string 64 and generally sealing engages the inner portion of well 62. Well 62 may have perforations 72 communicating an inner portion of well 62 with hydrocarbon reservoir 74. In accordance with the teachings of the present invention, shifting tool 10 is manipulated to shift and release sliding sleeve 44 in multiple positions relative to outer valve body 50 of sliding sleeve valve 42.

Figure 6:
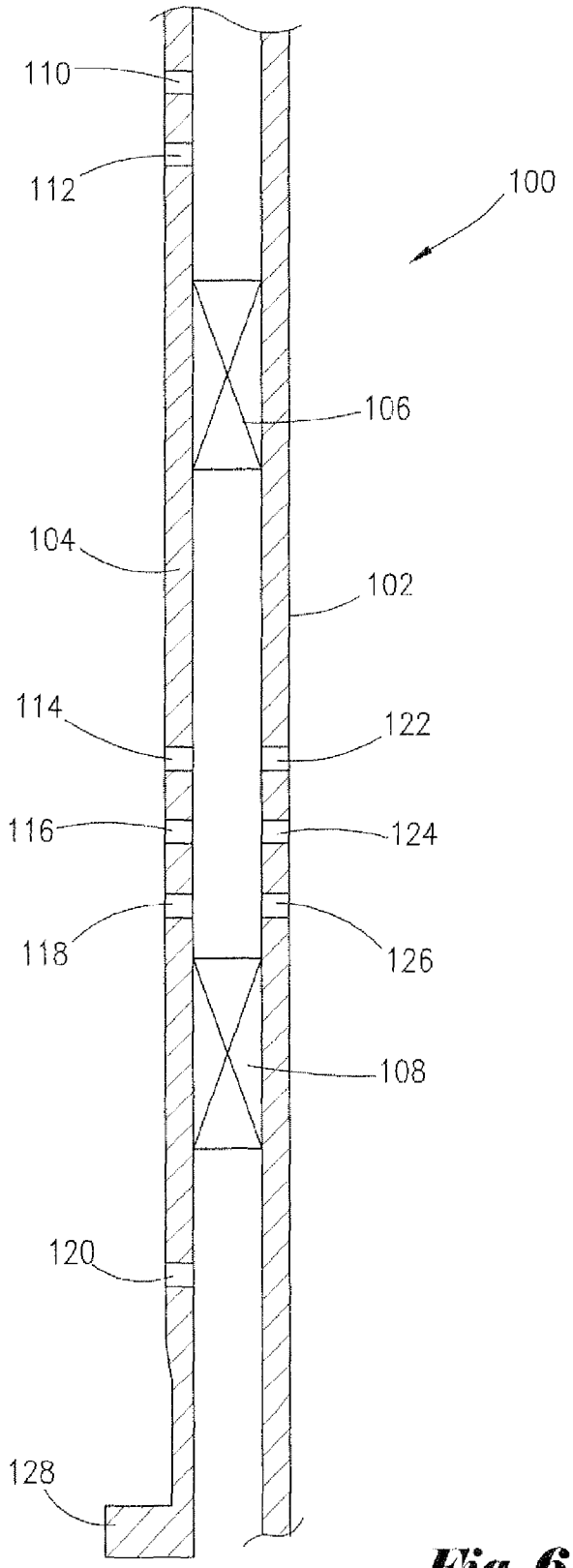
FIG. 6 is a partial cross-sectional side view of the mechanical choke valve of the present invention.

Shifting tool 10 may be used with a mechanical choke valve that includes a sliding sleeve with one or more series of different numbered and/or sized ports that could be selectively positioned in fluid communication with the ports of the outer valve body for controlled fluid flow into the well annulus. FIG. 6 reveals a mechanical choke valve that could be used in conjunction with shifting tool 10.

With reference to FIG. 6, mechanical choke valve 100 includes outer valve body 102 and internal sliding sleeve 104. Seals 106, 108 provide a sealing engagement between outer valve body 102 and internal sliding sleeve 104. Internal sliding sleeve 104 may contain a plurality of a series of ports (e.g., three or more series of ports). For example, internal sliding sleeve 104 may have a first series of ports 110, 112, a second series of ports 114, 116, 118, and a third series of ports 120. As described herein, internal sliding sleeve 104 may be shifted by displacement of shifting tool 10 to place internal sliding sleeve 104 in various positions relative to outer valve body 102 and in particular relative to and aligned with ports 122, 124, 126 of outer valve body 102. Engagement shoulder 28 of shifting tool key 14 cooperates with mating shoulder 128 of internal sliding sleeve 104 during shifting operations to move sliding sleeve 104. As also described herein, internal sliding sleeve 104 may be released at selective spatial positions relative to outer valve body 102 and in particular relative to and aligned with ports 122, 124, 126 of outer valve body 102 during releasing operations.

Depending on the desired flow rate and/or volume of tubing string fluid to be flowed into the well annulus, an operator may choose to place mechanical choke valve 100 in a fully opened position in which case the second series of ports 114, 116, 118 would be positioned in fluid communication with ports 122, 124, 126 of outer valve body 102. The operator may decide to place mechanical choke valve 100 in a first intermediate position (e.g., partially opened) in which case the first series of ports 110, 112 would be positioned in fluid communication with ports 112, 124, 126 of outer valve body 102 (i.e., between seals 106, 108) The operator may decide to place mechanical choke valve 100 in a second intermediate position (partially closed) in which case the third series of port 120 would be positioned in fluid communication with ports 112, 124, 126 of outer valve body 102. The operator may decide to place mechanical choke valve 100 in a fully closed positioned in which case a portion of internal sliding sleeve with no ports would be positioned to prevent fluid communication with ports 122, 124, 126 of outer valve body 102 (i.e., positioned between seals 106, 108 to block fluid communication to ports 122, 124, 126).

To achieve differing flow rates and/or volumes, each series of ports may have different numbers of ports, different sized ports or both. Within a series having two or more ports, each port mat be differently sized. The number and size of ports will depend in the desired flow rate and/or volume to be achieved.

While preferred embodiments of the present invention have been described, it is to he understood that the embodiments described are illustrative only and that the scope of the invention is to be defined solely by the appended claims when accorded a full range of equivalents, many variations and modifications naturally occurring to those skilled in the art from a perusal hereof.

What is claimed is:

1. A shifting tool for use with a mechanical sliding sleeve valve deployed in a tubing string of a hydrocarbon well, said sliding sleeve valve including an internal sliding sleeve and an outer valve body, said shifting tool comprising:

a top sub;

a shifting tool key positioned on said top sub, said shifting tool key radially expandable to engage said internal sliding sleeve to enable shifting of said internal sliding sleeve relative to said outer valve body by displacement of said shifting tool within said sliding sleeve valve during valve shifting operations and radially retractable to disengage from said internal sliding sleeve to enable release of said sliding sleeve valve from said shifting tool during valve release operations;

a bottom sub;

a reciprocating assembly interconnecting said top and bottom subs, said reciprocating assembly including an inner mandrel and an outer housing disposed about said inner mandrel, said outer housing having a biasing means to reciprocate said outer housing in a first direction during said valve shifting operations and an actuating means to cause reciprocation of said outer housing in a second direction during said valve release operations, said actuating means operatively cooperating with said shifting tool key during valve release operations to disengage said shifting tool key from said internal sliding sleeve to place said internal sliding sleeve at a spatial position relative to said valve body, said spatial position selected from a plurality of possible spatial positions.

2. The shifting tool according to claim 1, wherein said shifting tool key is retained on said top sub by a pair of retainers slidably positioned on said top sub and held in place by said inner mandrel.

3. The shifting tool according to claim 1, wherein said top sub and said bottom sub are each threadedly connected to said inner mandrel of said reciprocating assembly.

4. The shifting tool according to claim 1, wherein said outer housing of said reciprocating assembly is moveably connected to said inner mandrel of said reciprocating assembly.

5. The shifting tool according to claim 1, wherein said shifting tool key has an outer profile including an engagement shoulder, said engagement shoulder cooperating with a mating shoulder on said internal sliding sleeve, said cooperation between said engagement shoulder and said mating shoulder enabling said engagement of said shifting tool key with said internal sliding sleeve during valve shifting operations.

6. The shifting tool according to claim 5, wherein said outer profile of said shifting tool key further includes a releasing shoulder, said releasing shoulder capable of being actuated to radially retract said shifting tool key to disengage said engagement shoulder from said mating shoulder during valve release operations.

7. The shifting tool according to claim 6, wherein said releasing shoulder is actuated by reciprocation of said outer housing in said second direction.

8. The shifting tool according to claim 6, wherein a distance between said releasing shoulder and said actuating means is determinative of said spatial positioning of said internal sliding sleeve relative to said valve body.

9. The shifting tool according to claim 8, further comprising means to adjust said distance between said releasing shoulder and said actuating means.

10. The shifting tool according to claim 1, wherein said shifting tool key includes a biasing means, said biasing means causing said radial expansion of said shifting tool key.

11. The shifting tool according to claim 1, wherein said sliding sleeve valve includes an end sub, said actuating means engage said end sub to cause said reciprocation of said outer housing in said second direction during valve release operations to disengage said shifting tool key from said internal sliding sleeve.

12. The shifting tool according to claim 11, wherein said actuating means is a collet.

13. The shifting tool according to claim 1, wherein said mechanical sliding sleeve valve is a mechanical choke valve in which said internal sliding sleeve includes a plurality of a series of ports capable of providing fluid communication of a tubing string fluid there-through, each of said plurality of said series of ports providing a different flow rate and volume of said tubing string fluid flowing there-through, said spatial position selected for said internal sliding sleeve comprises one of said plurality of said series of ports which are aligned with one or more ports in said outer valve body.

14. A shifting tool for use with a mechanical sliding sleeve valve deployed in a tubing string of a hydrocarbon well, said sliding sleeve valve including an internal sliding sleeve, an outer valve body, and an end sub, said shifting tool comprising:

a top sub;

a shifting tool key positioned on said top sub, said shifting tool key including an outer profile having an engagement shoulder and a release shoulder, said shifting tool key including biasing means to radially expand said shifting tool key for engagement of said engagement shoulder with a mating shoulder of said internal sliding sleeve to enable shifting of said internal sliding sleeve relative to said outer valve body by displacement of said shifting tool within said sliding sleeve valve during valve shifting operations and to radially retract said shifting tool key to disengage said engagement shoulder from said mating shoulder to enable release of said sliding sleeve valve from said shifting tool during valve release operations;

a bottom sub;

a reciprocating assembly interconnecting said top and bottom subs, said reciprocating assembly including an inner mandrel and an outer housing disposed about said inner mandrel and having an upper end and a lower end, said outer housing having a biasing means to reciprocate said outer housing in a first direction during said valve shifting operations and an actuating means to cause reciprocation of said outer housing in a second direction during said valve release operations by compressing said biasing means of said reciprocating assembly when said actuating means engages said end sub, said actuating means operatively cooperating with said shifting tool key during valve release operations to cause said upper end of said outer housing to collapse said release shoulder to disengage said engagement shoulder from said mating shoulder to place said internal sliding sleeve at a spatial position relative to said valve body, said spatial position selected from three or more possible spatial positions based on a pre-selected distance between said actuating means and said release shoulder.

15. The shifting tool according to claim 14, wherein said actuating means is a collet.

16. The shifting tool according to claim 14, wherein said shifting tool is deployed on wireline.

17. The shifting tool according to claim 14, wherein said mechanical sliding sleeve valve is a mechanical choke valve in which said internal sliding sleeve includes a plurality of a series of ports capable of providing fluid communication of a tubing string fluid there-through, each of said plurality of said series of ports providing a different flow rate and volume of said tubing string fluid flowing there-through, said spatial position selected for said internal sliding sleeve comprises one of said plurality of said series of ports which are aligned with one or more ports in said outer valve body.

18. A method of operating a mechanical sliding sleeve valve having an internal sliding sleeve, an outer valve body and an end sub for selective placement of said internal sliding sleeve at a spatial position relative to said valve body, said spatial position being selected from any number of possible spatial positions, comprising the steps of:

(a) providing a shifting tool comprising:

(i) a top sub;

(ii) a shifting tool key positioned on said top sub, said shifting tool key including an outer profile having an engagement shoulder and a release shoulder, said shifting tool key including biasing means to radially expand said shifting tool key for engagement of said engagement shoulder with a mating shoulder of said internal sliding sleeve to enable shifting of said internal sliding sleeve relative to said outer valve body by displacement of said shifting tool within said sliding sleeve valve during valve shifting operations and to radially retract said shifting tool key to disengage said engagement shoulder from said mating shoulder of said internal sliding sleeve to enable release of said sliding sleeve valve from said shifting tool during valve release operations;

(iii) a bottom sub;

(iv) a reciprocating assembly interconnecting said top and bottom subs, said reciprocating assembly including an inner mandrel and an outer housing disposed about said inner mandrel and having an upper end and a lower end, said outer housing having a biasing means to reciprocate said outer housing in a first direction during said valve shifting operations and an actuating means to cause reciprocation of said outer housing in a second direction during said valve release operations by compressing said biasing means of said reciprocating assembly when said actuating means engages said end sub, said actuating means operatively cooperating with said shifting tool key during valve release operations to cause said upper end of said outer housing to collapse said release shoulder to disengage said engagement shoulder from said mating shoulder to place said internal sliding sleeve at a spatial position relative to said valve body, said spatial position selected from three or more possible spatial positions based on a pre-selected distance between said actuating means and said release shoulder;

(b) pre-selecting said distance between said actuating means and said release shoulder;

(c) deploying said shifting tool down a tubing string, said tubing string including said sliding sleeve valve;

(d) causing said engagement shoulder to engage said mating shoulder to operatively connect said shifting tool and said internal sliding sleeve;

(e) shifting said internal sliding sleeve relative to said valve body by displacing said shifting tool within said sliding sleeve valve;

(f) reciprocating said outer housing in said second direction by causing said actuating means to engage said end sub;

(g) causing said upper end of said outer housing to collapse said release shoulder to disengage said engagement shoulder from said mating shoulder thereby releasing said internal sliding sleeve from said shifting tool at a selected spatial position relative to said valve body predetermined by said distance between said actuating means and said release shoulder.

19. The method according to claim 18, wherein said selected spatial position of said internal sliding sleeve achieved in step (g) is a fully closed position, a plurality of intermediate positions, an equalizing position, or a fully opened position.

20. The method according to claim 18, wherein mechanical sliding sleeve valve is a mechanical choke valve in which said internal sliding sleeve includes a plurality of a series of ports capable of providing fluid communication of a tubing string fluid there-through, each of said plurality of said series of ports providing a different flow rate and volume of said tubing string fluid flowing there-through and wherein said spatial position selected for said internal sliding sleeve in step (g) comprises one of said plurality of said series of ports which are aligned with one or more ports in said outer valve body.

21. The method according to claim 18, wherein said step of pre-selecting said distance between said actuating means and said release shoulder is accomplished by (i) adjusting a length of said outer housing where said actuating means is at a fixed position on said outer housing, (ii) adjusting a position of said actuating means on said outer housing where said actuating means is detachably fixed to said outer housing, or (iii) affixing a selected outer housing having a specified length and a fixed actuating means thereon, said selected outer housing chosen from a plurality of outer housings each having a different length and a fixed actuating means thereon.

22. A mechanical choke valve deployed in a tubing string of a hydrocarbon well, comprising:

an internal sliding sleeve including a mating shoulder for operable engagement with the shifting tool of claim 1, said internal sliding sleeve including a plurality of a series of ports capable of providing fluid communication of a tubing string fluid there-through, each of said plurality of said series of ports providing a different flow rate and volume of said tubing string fluid flowing there-through; and an outer valve body disposed about said internal sliding sleeve, said outer valve body including one or more ports capable of providing fluid communication of said tubing string fluid there-through; wherein each of said plurality of said series of ports in said internal sliding sleeve is capable of being selectively aligned by displacement of said shifting tool with said one or more ports of said outer valve body to provide fluid communication of said tubing string fluid to a well annulus;

wherein said plurality of said series of ports of said internal sliding sleeve include (i) a first series of ports that when aligned with said one or more ports of said outer valve body place said mechanical choke valve in a fully opened position, (ii) a second series of ports that when aligned with said one or more ports of said outer valve body place said mechanical choke valve in a first intermediate position, and (iii) a third series of ports that when aligned with said one or more ports of said outer valve body place said mechanical choke valve in a second intermediate position.

23. The mechanical choke valve according to claim 22, wherein said outer valve body includes a detent groove and said internal sliding sleeve includes a locking collet, said locking collect being positioned within said detent groove to lock said internal sliding sleeve in place when said internal sliding sleeve is released by said shifting tool to thereby prevent unintentional shifting of said internal sliding sleeve.

24. A mechanical choke valve deployed in a tubing string of a hydrocarbon well, comprising:

an internal sliding sleeve including a mating shoulder for operable engagement with the shifting tool of claim 14, said internal sliding sleeve including a plurality of a series of ports capable of providing fluid communication of a tubing string fluid there-through, each of said plurality of said series of ports providing a different flow rate and volume of said tubing string fluid flowing there-through; and an outer valve body disposed about said internal sliding sleeve, said outer valve body including one or more ports capable of providing fluid communication of said tubing string fluid there-through; wherein each of said plurality of said series of ports in said internal sliding sleeve is capable of being selectively aligned by displacement of said shifting tool with said one or more ports of said outer valve body to provide fluid communication of said tubing string fluid to a well annulus;

wherein said plurality of said series of ports of said internal sliding sleeve include (i) a first series of ports that when aligned with said one or more ports of said outer valve body place said mechanical choke valve in a fully opened position, (ii) a second series of ports that when aligned with said one or more ports of said outer valve body place said mechanical choke valve in a first intermediate position, and (iii) a third series of ports that when aligned with said one or more ports of said outer valve body place said mechanical choke valve in a second intermediate position.

25. The mechanical choke valve according to claim 24, wherein said outer valve body includes a detent groove and said internal sliding sleeve includes a locking collet, said locking collect being positioned within said detent groove to lock said internal sliding sleeve in place when said internal sliding sleeve is released by said shifting tool to thereby prevent unintentional shifting of said internal sliding sleeve.

* * * * *